US007165656B2

(12) United States Patent
Valjus et al.

(10) Patent No.: US 7,165,656 B2
(45) Date of Patent: Jan. 23, 2007

(54) ELEVATOR AND GUIDE FIXING BRACKET FOR AN ELEVATOR

(75) Inventors: Petteri Valjus, Helsinki (FI); Aripekka Anttila, Jarvenpaa (FI); Jorma Mustalahti, Hyvinkaa (FI); Esko Aulanko, Kerava (FI)

(73) Assignee: Kone Corporation, Helsinki (FI)

( * ) Notice: Subject to any disclaimer, the term of this patent is extended or adjusted under 35 U.S.C. 154(b) by 42 days.

(21) Appl. No.: 10/888,836

(22) Filed: Jul. 12, 2004

(65) Prior Publication Data

US 2005/0006184 A1 Jan. 13, 2005

(51) Int. Cl.
*B66B 7/02* (2006.01)

(52) U.S. Cl. ..... 187/408; 187/406

(58) Field of Classification Search ..... 187/406, 187/408

See application file for complete search history.

(56) References Cited

U.S. PATENT DOCUMENTS

| | | | | |
|---|---|---|---|---|
| 1,702,783 | A * | 2/1929 | Kiesling | 187/408 |
| 2,463,215 | A * | 3/1949 | Strachan | 187/408 |
| 3,601,938 | A | 8/1971 | Loomis | |
| 3,799,437 | A * | 3/1974 | Scherbaum | 238/349 |
| 3,948,358 | A * | 4/1976 | Atkey | 187/408 |
| 5,284,226 | A * | 2/1994 | Makimura et al. | 187/408 |
| 5,520,264 | A * | 5/1996 | Korhonen | 187/408 |
| 6,371,249 | B1 * | 4/2002 | Schops et al. | 187/408 |
| 6,481,538 | B2 * | 11/2002 | Blackaby et al. | 187/408 |
| 6,672,013 | B1 * | 1/2004 | Glassey et al. | 52/30 |
| 2004/0159501 | A1 * | 8/2004 | Bloch et al. | 187/408 |

FOREIGN PATENT DOCUMENTS

| | | |
|---|---|---|
| CH | 532 528 | 1/1973 |
| EP | 0 784 030 B1 | 6/1994 |
| JP | 52-124641 | 10/1977 |
| JP | 1-150687 | 6/1989 |
| JP | 1-271385 | 10/1989 |
| JP | 6-156925 | 6/1994 |
| JP | 2002-326777 | 11/2002 |
| SU | 988 733 | 1/1983 |

* cited by examiner

*Primary Examiner*—Kathy Matecki
*Assistant Examiner*—Eric E. Pico
(74) *Attorney, Agent, or Firm*—Harness, Dickey & Pierce, P.L.C.

(57) ABSTRACT

Elevator, preferably an elevator without machine room, comprising at least an elevator car (101) moving along guide rails (1), a counterweight (102) moving along guide rails (2) and an elevator motor (106) driving them, wherein the guide rails are fixed in place by means of guide fixing brackets (112). The width of the guide fixing bracket (112) in the vicinity of the car guide rails (1) is substantially equal to the width of the car guide rail plus the thickness of the rail clips in the guide fixing bracket.

17 Claims, 8 Drawing Sheets

ELEVATOR AND GUIDE FIXING BRACKET FOR AN ELEVATOR

The present invention relates to an elevator, more specifically, an elevator having a guide fixing bracket used on guide rails.

BACKGROUND OF THE INVENTION

The narrow width of elevator shafts has become a notable factor as elevator solutions without machine room have become common. For efficient space utilization, the elevator ropes have been fitted to run in the elevator shaft at a close distance from the elevator guide rails, or some other component, e.g. the elevator car, may be closely spaced from the elevator guide rails. Another problem is how to implement the fixing of the guide rails in a workable way. With current guide rail fixing solutions, which are generally based on a clamping fixing method, mounting the guide rails is a slow and difficult operation.

Prior art is described in patent specification U.S. Pat. No. 4,593,794. This specification discloses a solution representing the traditional way of fixing the guide rails in an elevator shaft. The elevator guide rails and counterweight guide rails, which have a T-shaped cross-sectional form, are secured with separate guide fixing brackets to the wall of the elevator shaft. However, this solution has the drawback that each guide rail requires a separate guide fixing bracket, which adds to the number of fixing components needed, such as e.g. the number of bolts and separate guide fixing brackets. In addition, because of the large number of components, mounting the guide rails is a slow and difficult task. As for space utilization, the solution in question is not optimal, which is due to the large number of components and their size. Moreover, in the prior-art fixing arrangement, the distance between the guide rails as well as the distance between the guide fixing brackets is large.

SUMMARY OF THE INVENTION

The object of the present invention is to overcome the above-mentioned drawbacks and to achieve an advantageous elevator in respect of space utilization and a compact guide fixing bracket which can be used to fix several guide rails in place with a single guide fixing bracket.

In an embodiment of the invention, a guide rail fixing arrangement is achieved that reduces the space between the guide rails and the guide fixing brackets. This makes shaft space available for other uses and more space is provided for other elevator components; for example, more space is left between the elevator ropes and the guide rails and a larger scope is allowed for elevator movement, and it permits advantageous layout solutions regarding efficiency of space utilization. In addition, reducing the space between the guide rails and the guide fixing brackets makes it possible to use a traction sheave of a particularly small diameter in the elevator machine, the elevator ropes being fitted to run at a close distance from the elevator ropes to achieve advantageous space utilization in the elevator shaft. These are implemented by producing the guide fixing bracket according to the invention such that it has a small width, preferably substantially equal to the width of the car guide rail, so the bracket width only exceeds the width of the car guide rail by the thickness of the rail clips comprised in the guide fixing bracket. In addition, by using a guide fixing bracket according to the invention, it is possible to fix more than one guide rail by means of a single guide fixing bracket, which allows e.g. a car guide rail and a counterweight guide rail to be fixed by a single guide fixing bracket. The guide fixing bracket has therefore a place for the fixing of at least two guide rails. This increases the space available in the elevator shaft and moreover the guide fixing bracket of the invention is of simple construction. Due to the light weight and compact size of the components of the guide fixing bracket, such as e.g. the body part and rail clip components, the number of parts comprised in the guide fixing bracket is small. Due to the simple construction, light weight and small number of parts of the guide fixing bracket, mounting, positioning and securing the guide rails is considerably easier than when prior-art solutions are used. In addition, in the elevator of the invention, the installation of the guide rails and guide fixing brackets can be quickly and accurately implemented. A light-weight guide fixing bracket is achieved by making at least the body part from a light material suited for the purpose, preferably aluminum. Having a simple construction, light weight and small number of parts, the guide fixing bracket is a cheap assembly. The body part of the guide fixing bracket can be manufactured e.g. by casting in mold, thus allowing low manufacturing costs and large production quantities.

By applying the invention, one or more of the following advantages, among others, can be achieved:

- With a single guide fixing bracket, more than one guide rail can be fixed in place
- The guide fixing bracket has a light weight and few parts
- The guide fixing bracket is a low-cost assembly
- By using the guide fixing bracket, accurate positioning of the car guide rail and the counterweight guide rail is easy to implement
- The guide fixing bracket is as narrow as possible and it makes it possible to reduce the width of the space between the guide rails and the guide fixing brackets, thus leading to an advantageous elevator in respect of space utilization
- A guide fixing bracket of compact size, which is easy and light to mount
- At least the body part of the guide fixing bracket is produced from a material suited for the purpose, preferably aluminum
- The invention makes it possible to reduce number of tightening elements, preferably bolts, used for fixing the guide rails. The guide fixing brackets used before required two fixing bolts for securing one guide rail, whereas the guide fixing bracket of the invention requires only one fixing bolt for each guide rail
- In the elevator of the invention, it is possible to use a traction sheave of particularly small diameter in the elevator machine
- The guide fixing bracket of the invention allows a "floating" use of the rail clip, in other words, the rail clip can be used for merely applying compression to the guide rail, and it does not have to bear any forces acting in other directions.

BRIEF DESCRIPTION OF THE DRAWINGS

In the following, the invention will be described in detail by the aid of a few examples of its embodiments with reference to the attached drawings, wherein.

DETAILED DESCRIPTION OF EXAMPLE EMBODIMENTS

Figure 1:
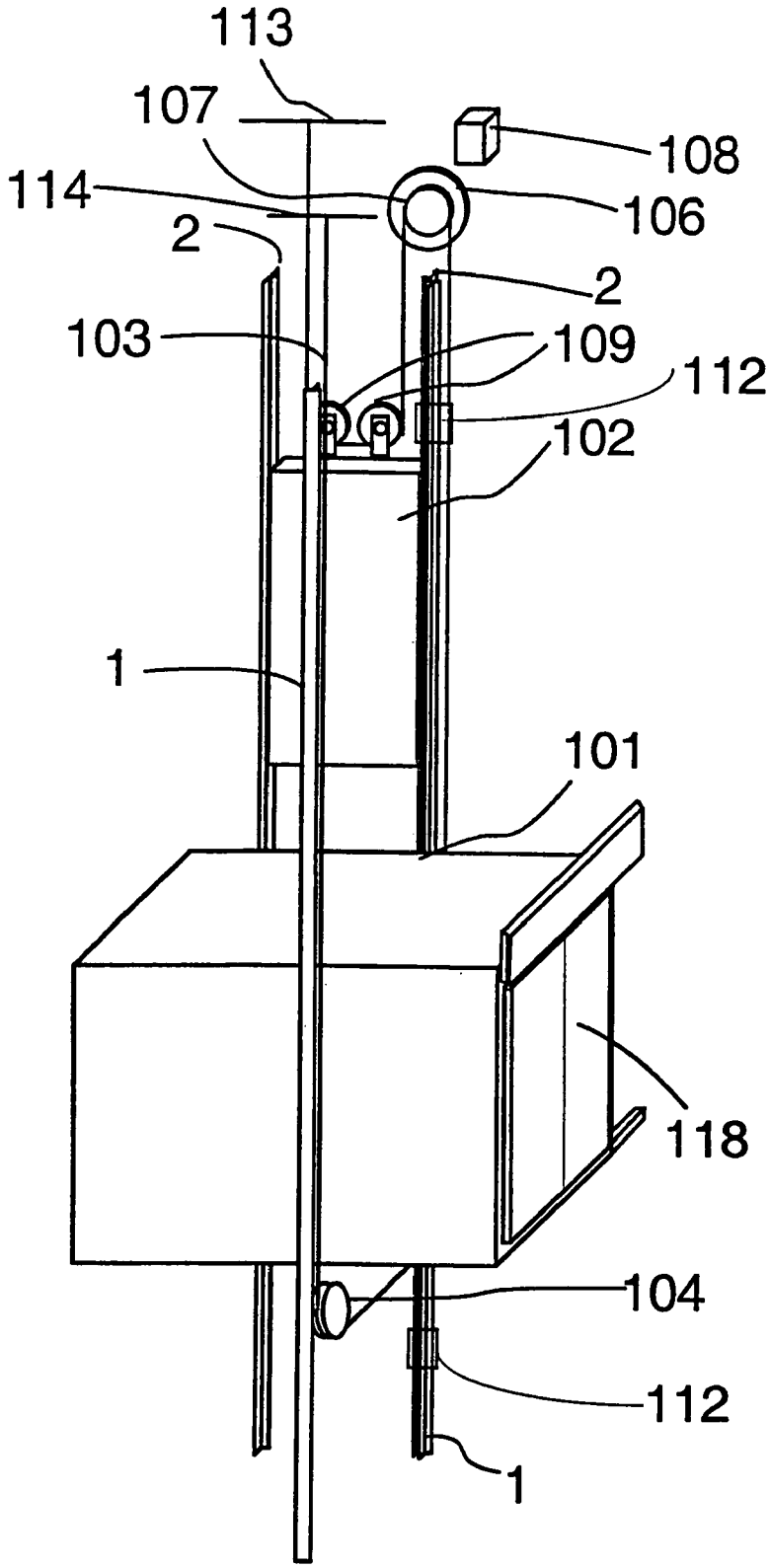
FIG. 1 is a diagrammatic representation of an elevator according to the invention.

FIG. 1 is a diagrammatic representation of the construction of an elevator. The elevator is preferably an elevator without machine room, in which the drive machine 106 is placed in the elevator shaft. The elevator presented in the figure is a traction sheave elevator with machine above. The passage of the hoisting ropes 103 of the elevator is as follows: One end of the ropes is immovably fixed to an anchorage 113 located in the upper part of the shaft above the path of a counterweight 102 moving along counterweight guide rails 2. From the anchorage, the ropes run downward and are passed around diverting pulleys 109 suspending the counterweight, which diverting pulleys 109 are rotatably mounted on the counterweight 102 and from which the ropes 103 run further upward to the traction sheave 107 of the drive machine 106, passing around the traction sheave along the rope grooves of the sheave. From the traction sheave 107, the ropes 103 run further downward to the elevator car 101 moving along the car guide rails 1 of the elevator, passing under the car via diverting pulleys 104 used to suspend the elevator car on the ropes, and going then upwards again from the elevator car to an anchorage 114 in the upper part of the elevator shaft, to which anchorage the second end of the ropes 103 is immovably fixed. Anchorage 113 in the upper part of the shaft, the traction sheave 107, diverting pulley and the diverting pulley 109 suspending the counterweight on the ropes are preferably so disposed in relation to each other that both the rope portion going from the anchorage 113 to the counterweight 102 and the rope portion going from the counterweight 102 to the traction sheave 107 are substantially parallel to the path of the counterweight 102. Similarly, a solution is preferred in which the anchorage 114 in the upper part of the shaft, the traction sheave 107 and the diverting pulleys 104 suspending the elevator car on the ropes are so disposed in relation to each other that the rope portion going from the anchorage 114 to the elevator car 101 and the rope portion going from the elevator car 101 to the traction sheave 107 are substantially parallel to the path of the elevator car 101. With this arrangement, no additional diverting pulleys are needed to define the passage of the ropes in the shaft. The rope suspension acts in a substantially centric manner on the elevator car 101, provided that the rope pulleys 104 suspending the elevator car are mounted substantially symmetrically relative to the vertical center line passing via the center of gravity of the elevator car 101. The elevator guide rails, the counterweight guide rails 2 and the car guide rails 1, are fixed in place by means of guide fixing brackets 112 according to the invention.

The drive machine 106 placed in the elevator shaft is preferably of flat construction, in other words, the machine 106 has a small thickness dimension as compared with its width and/or height, or at least the machine 106 is slim enough to be accommodated between the elevator car 101 and a wall of the elevator shaft. The machine 106 may also be placed differently, e.g. by disposing the slim machine partly or completely between an imaginary extension of the elevator car 101 and a shaft wall. The elevator shaft is advantageously provided with equipment required for the supply of power to the motor driving the traction sheave 107 as well as equipment needed for elevator control, both of which can be placed in a common instrument panel 108 or mounted separately from each other or integrated partly or wholly with the drive machine 106. The drive machine 106 may be of geared or gearless type. A preferable solution is a gearless machine comprising a permanent magnet motor. The drive machine 106 may be fixed to a wall of the elevator shaft, to the ceiling, to a guide rail 1 or guide rails or to some other structure, such as a beam or frame. In the case of an elevator with machine below, a further possibility is to mount the above-mentioned components on the bottom of the elevator shaft. FIG. 1 illustrates the economical 2:1 suspension, but the invention can also be implemented in an elevator using a 1:1 suspension ratio, in other words, in an elevator in which the hoisting ropes 103 are connected directly to the counterweight 102 and elevator car 101 without diverting pulleys 109. Other suspension arrangements are also possible in an implementation of the invention. The elevator presented in the figure has automatic telescoping doors 118, but other types of automatic doors or turning doors may also be used within the framework of the invention. By using the guide fixing bracket 112 of the invention, the distance between the guide rails 1 and 2 can be reduced. This makes it possible to use a traction sheave 107 having a particularly small diameter in the drive machine 106, preferably in a situation where the elevator ropes 103 have been fitted to run at a close distance from the guide rails as illustrated in the figure. For example, when the back side width of the car guide rail is 80 mm, a mounting width of about 100 mm or even less near the car guide rail 1 can easily be achieved by using the guide fixing bracket 112 of the invention.

Figure 2:
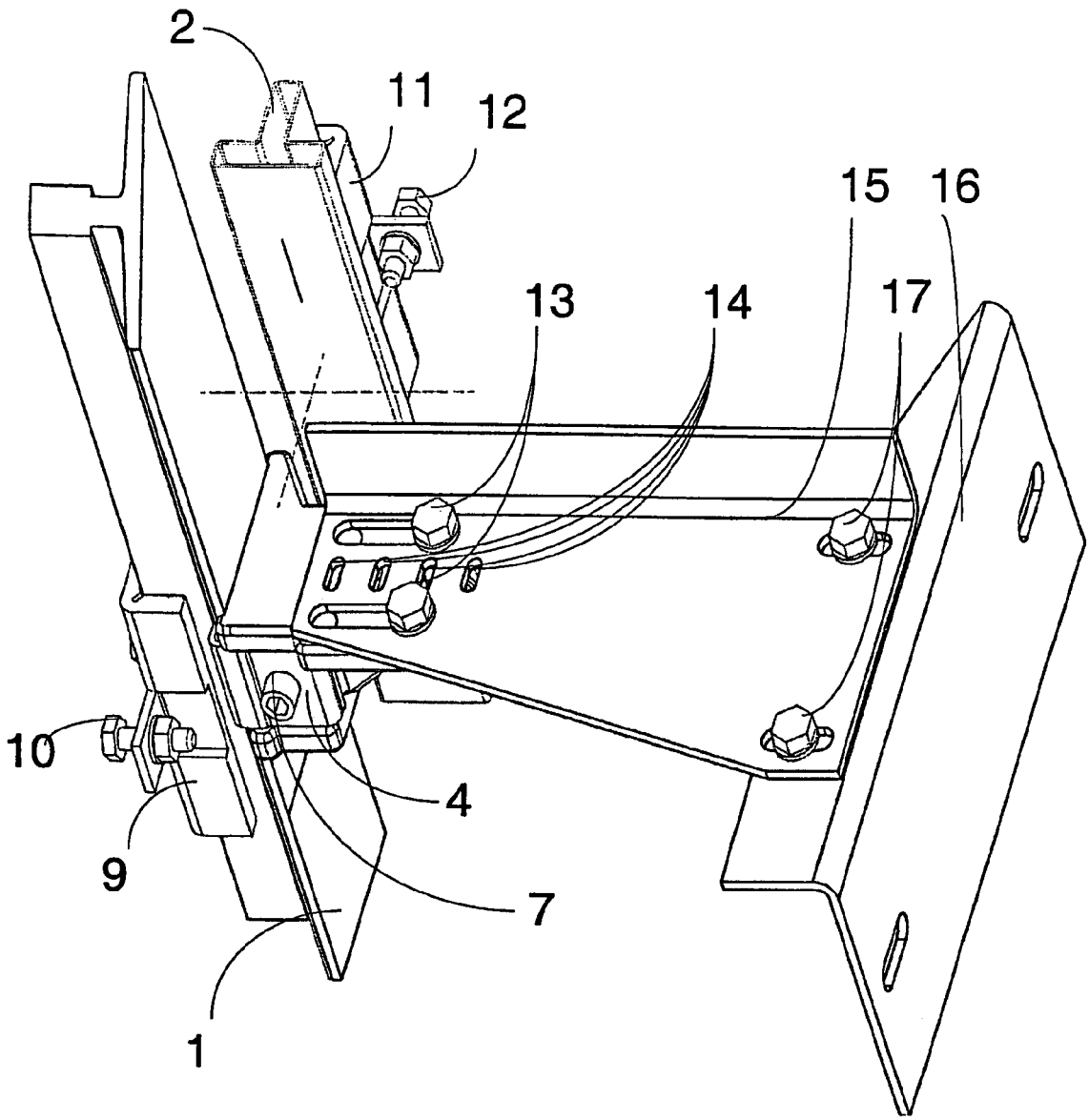
FIG. 2 presents a guide fixing bracket according to the invention and guide rails of T-shaped cross-section fitted to it.

FIG. 2 shows a guide fixing bracket 112 according to the invention and the guide rails attached to it. A elevator car guide rail 1 of T-shaped cross-section and a counterweight guide rail 2 are fastened to the body part 3 of the guide fixing bracket 112 by means of rail clips, of which only rail clip 4 is shown in FIG. 2. A sliding guide 9 of the elevator car 101 moving along the car guide rail 1 of the elevator is shown in the figure as a component separate from the elevator car 101, but in reality it is fitted as a part of the elevator car 101 and/or elevator car frame by means of a fastening element 10. The counterweight guide rail 2 is presented in the figure as a hollow guide rail of T-shaped cross-section, but in an embodiment according to the invention it is also possible use other types of guide rails, such as e.g. the same type of guide rail for both counterweight 102 and elevator car 101. Likewise, the sliding guide 11 is presented in the figure as component separate from the counterweight 102, but in reality it is fitted as a part of the counterweight 102 and/or counterweight frame by means of a fastening element 12. It is not essential to the invention what type of guides are used for guiding the elevator car 101 and counterweight 102 on their path along the guide rails 1 and 2. The guides used may consist of e.g. sliding guides or roller guides. The body part 3, which in the figure serves as a fastening element for fastening both the car guide rail 1 and the counterweight guide rail 2, is additionally provided with adjustment holes 14 to allow adjustment of the position of the guide rails. By utilizing these adjustment holes 14, the position of the guide rail can be adjusted e.g. by means of a screwdriver. The bracket 112 is tightened in place by means of tightening elements 13. The shape of the body part 3 and the adjustment holes and tightening holes provided in it allow the positioning of the guide rails to be easily and accurately implemented because only few parts are needed for adjusting and positioning the guide rails. The body part 3 is fixed in place, e.g. to a wall of the elevator shaft, by means of fastening elements 15, 16. Their shape and fixing in place is not essential to the prgsent invention, and they are fastened in a manner known in itself.

Figure 3:
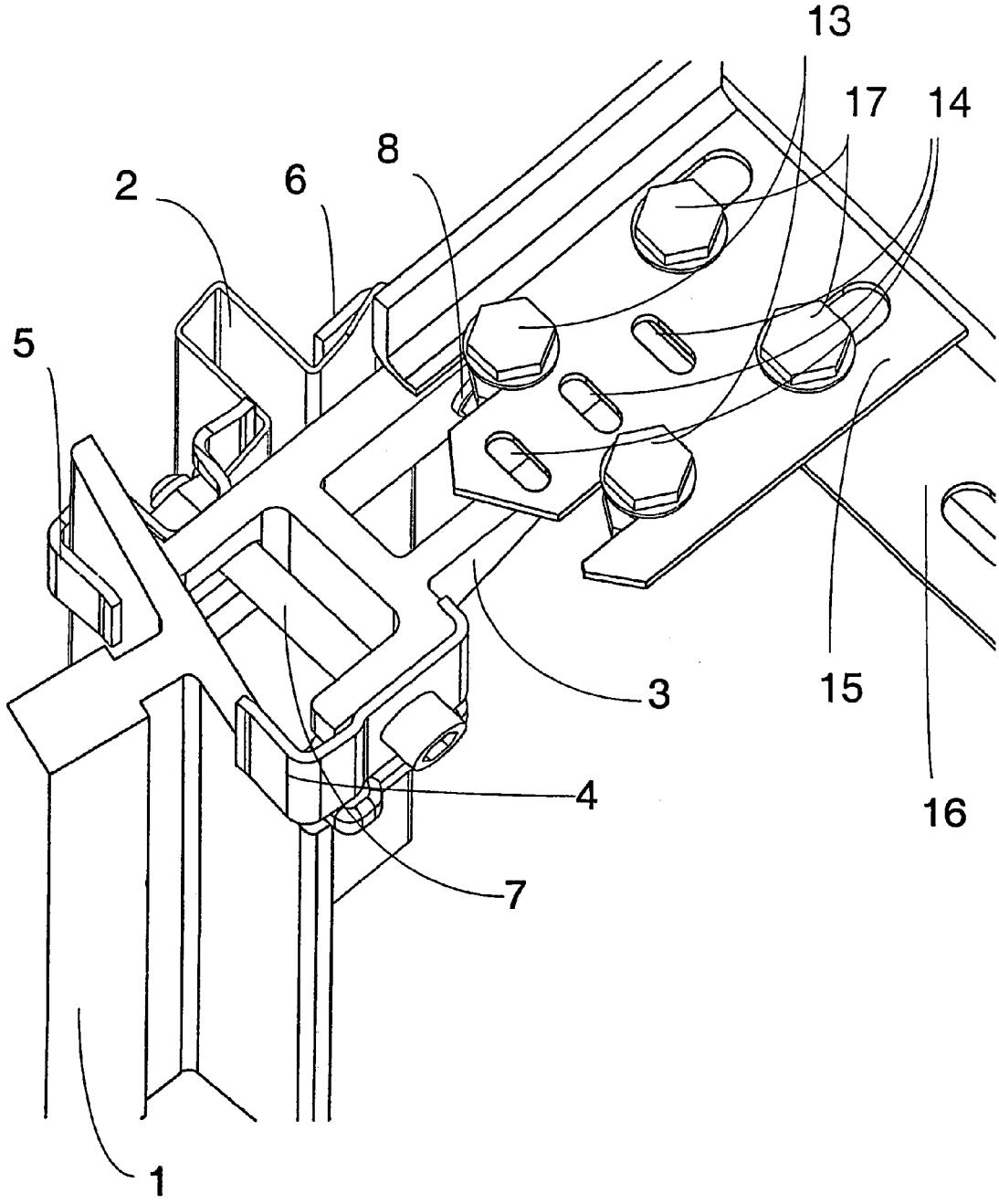
FIG. 3 shows a longitudinal cross-section of a guide fixing bracket according to the invention, in the plane x—x indicated in FIG. 5, and the guide rails attached to it.

FIG. 3 illustrates the same arrangement for fixing two guide rails by means of a guide fixing bracket 112 according to the invention. In this figure, the body part 3 of the guide fixing bracket 112 is sectioned along the plane x—x shown in FIG. 5. Likewise, the car guide rail 1 and the counterweight guide rail 2 as well as the fastening element 15 in FIG. 3 are obliquely sectioned so that one can see from the figure how the guide rails 1 and 2 are fastened to the body part 3. In the example in FIG. 3, the two guide rails, the car guide rail 1 and the counterweight guide rail 2, are fitted in place by means of a guide fixing bracket 112 according to the invention. The car guide rail 1 is fixed to the body part 3 by means of rail clips 4 and 5 and the counterweight guide rail 2 is fixed to the body part 3 by means of rail clips 5 and 6. Thus, the same rail clip 5 serves to fix in place both the car guide rail 1 and the counterweight guide rail 2, in other words, these rails have a common rail clip. Rail clips 4 and 5 are tightened in place on the body part 3 by means of a tightening element 7, which is preferably a bolt or an equivalent tightening means. In this way, the car guide rail 1 and one side of the counterweight guide rail 2 are tightened in place on the body part 3. The other side of the counterweight guide rail 2 is tightened in place on the body part 3 by means of a rail clip 6 and a tightening element 8. The body part 3 is fitted in place in the elevator shaft by means of fastening elements 15 and 16, on which the body part 3 is fitted in place in the correct position and at the desired distance from the wall of the elevator shaft by means of adjustment holes 14 and tightening elements 13. The fastening elements are fitted to each other by means of tightening elements 17. In the example solution described above, only two tightening elements, preferably bolts, are needed for fixing two guide rails. When the guide fixing bracket 112 of the invention is used, only as many bolts are needed for fixing the guide rails 1 to the body 3 as there are guide rails, or even fewer, when at least two guide rails are to be fixed. In prior art solutions, 2 bolts have been needed for each guide rail. The shaping of the body part 3 and the rail clips 4, 5 allow the number of tightening elements needed to be reduced as compared with earlier solutions, and the number of parts required for the fixing of the guide rails can be reduced.

Figure 4:
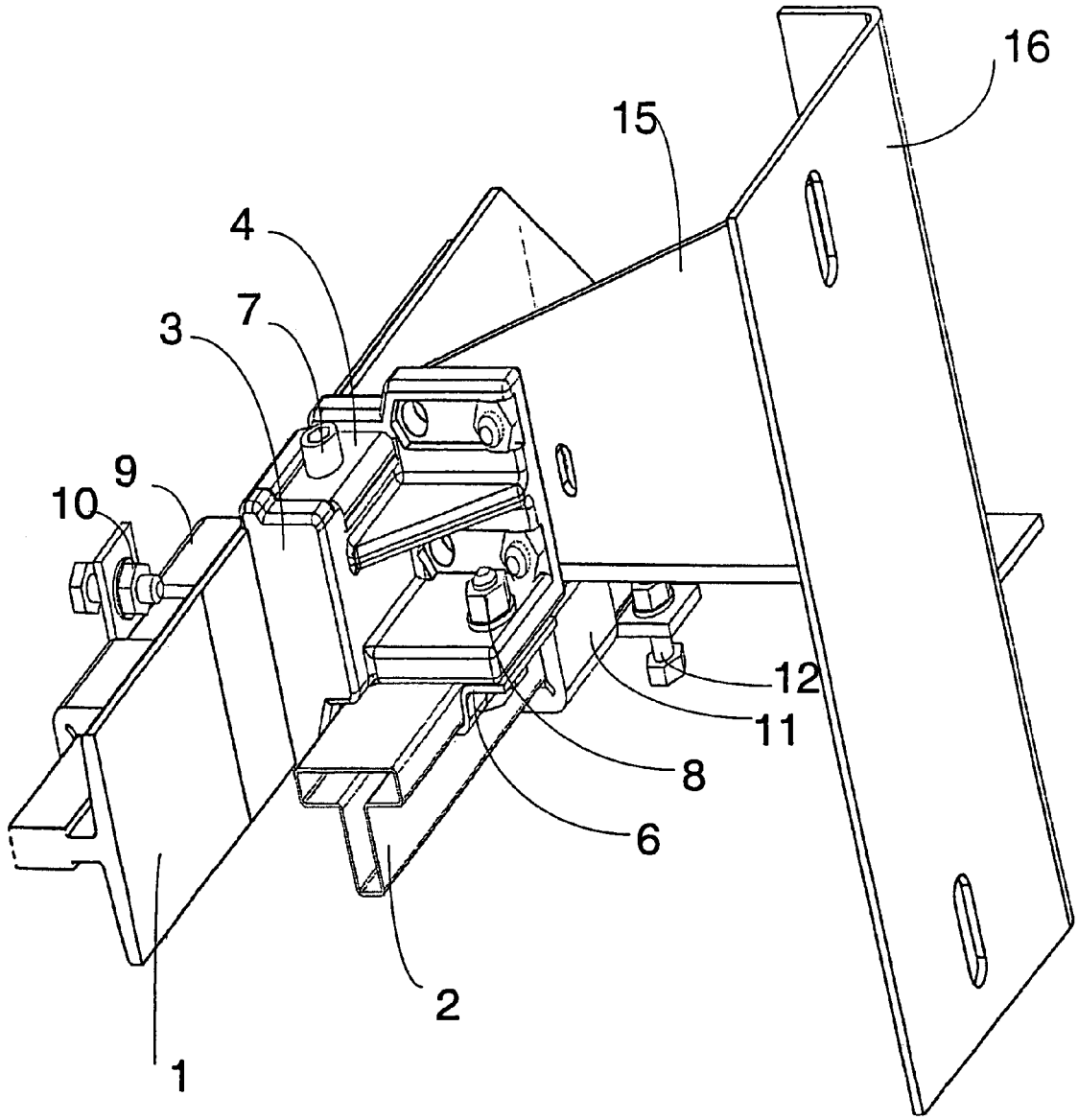
FIG. 4 presents a guide fixing bracket according to the invention and the guide rails fixed to it, in a view seen obliquely from below, FIG. 5 the body part of a guide fixing bracket according to the invention.

FIG. 4 presents the guide fixing bracket of the invention and the elevator parts secured by means of it as seen obliquely from below. The figure shows how the guide rails 1 and 2 are fastened to the body part of the guide fixing bracket of the invention by means of rail clips. It can be seen from FIG. 4 how the car guide rail 1 is fastened to the body part by rail clip 4, which is tightened in place by means of tightening element 7. The guide fixing bracket only exceeds the width of the car guide rail 1 by the thickness of the rail clip 4. The counterweight guide rail 2 is fastened from the other side by means of rail clip 6, which is tightened in place by means of tightening element 8. From this figure one cannot see how the rail clip 5 common to the two guide rails 1,2 is fastened in place. However, this is visible from the previous figures. The body part 3 is fitted in place in the elevator shaft by means of fastening elements 15 and 16.

From FIGS. 4 and 2, one can see how the elevator guide rails are secured in place by means of guide fixing brackets whose width in the in the immediate vicinity of the car guide rail substantially equals the width of the car guide rail plus the thickness of the rail clips in the guide fixing bracket. In the case of the most commonly used guide rails, it is easy to achieve a relative value of the widths of the guide fixing bracket and car guide rail relative to each other at which the width of the guide rail fixing arrangement is at most 150% of the rail width. The width of the guide fixing bracket may exceed the width of the rail back by as much as 15% or more if necessary, because the same guide fixing bracket is applicable for use with several different guide rails and different rail thicknesses with different widths.

Figure 5:
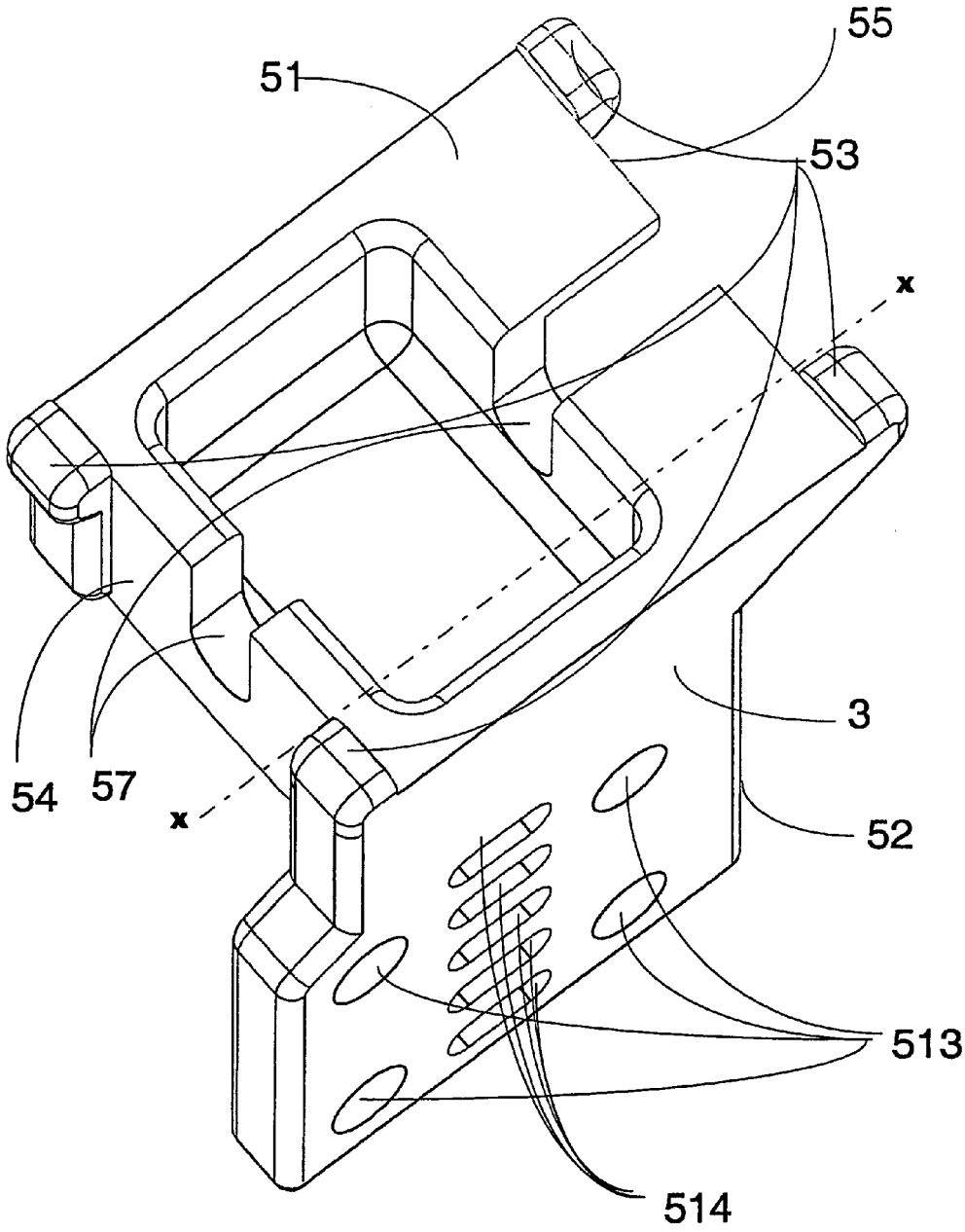

FIG. 5 presents the body part 3 of a guide fixing bracket according to the invention. The surface 51 of the body part is fitted against a guide rail, such as e.g. the car guide rail as in the examples described above. The guide rail can be fitted in the correct position by the aid of fitting parts 53 provided in the body part 3, between which the body part can be easily positioned. The fitting parts 35 also serve as an aid when the rail clips are to be fitted in place to fasten the guide rails to the guide fixing bracket, e.g. against surfaces 54 and 55 of the body part. The fitting part 53 has a thickness equal to that of the rail clip in the portion exceeding the body part or preferably even smaller than the thickness of the rail clip. The body part 3 need not necessarily have any fitting parts 53 at all. The slots 57 in the body part are for the tightening element, by means of which e.g. a car guide rail and a counterweight guide rail are fastened to the guide fixing bracket and tightened in place. The tightening element 7 presented in the previous figures, e.g. in FIG. 3, is fitted in the slots 57. The car guide rail and one side of the counterweight guide rail can be fastened in place by means of a single tightening element 7. Other guide rails, such as e.g. a counterweight guide rail 2 as presented in FIG. 3 can be fitted and fastened against surface 52. The body part 3 is also provided with adjustment holes 514, allowing easy and accurate positioning of the guide rails, and holes 513 for securing the body part 3 to the fastening elements.

Figure 6:
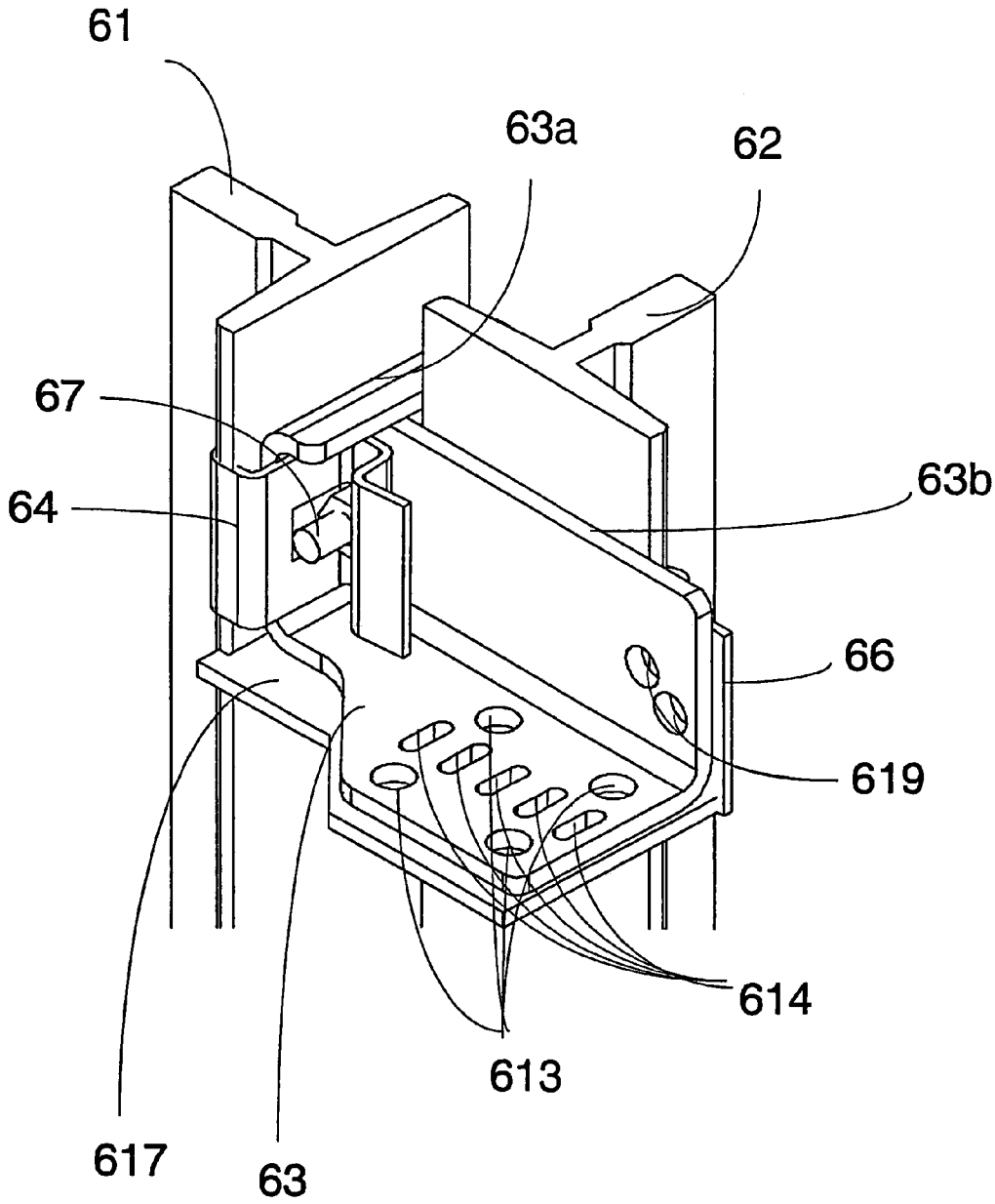
FIG. 6 presents a second guide fixing bracket according to the invention and guide rails of T-shaped cross-section fitted to it.

FIG. 6 presents a second guide fixing bracket according to the invention. In the guide fixing bracket in FIG. 6, the body part 63 is fitted on a support plate 617. The support plate 617 has fitting slots for the guide rails 61 and 62, by the aid of which the guide rails 61 and 62 are positioned in place. The support plate 617 can be fitted in place on the body part 63 by means of fastening elements, preferably bolts, to be placed in the holes 613. Using a support plate 617 makes it possible to implement the horizontal positioning of different guide rail combinations in the elevator shaft and to transmit the horizontal forces appearing when the elevator safety gear grips and during the loading of the car via the body part 63 to the wall structure. The guide fixing bracket is fitted in place on the wall structure in a manner known in itself. The width of the body part 63 and the support plate 617 in vicinity of the car guide rail 16 substantially equals the width of the car guide rail plus the width of the surfaces (cf. fitting parts 53 presented in the previous figures) extending beyond the car guide rail fitting slot provided in the support plate of the guide fixing bracket. In this figure, the guide rails 61,62 are fixed in place by means of rail clips 64,66 and a third rail clip not visible in FIG. 6. Rail clip 64 in the figure is of the same shape as the rail clip not visible in the figure, which is placed between the guide rails 61 and 62 and which serves to fix both guide rails in place. Thus, in a case as illustrated in FIG. 6, to fix the guide rails 61,62 in place, only three rail clips and two tightening elements are needed, one 67 of which tightening elements is shown in the figure while the other is only indicated by its place 619. The positioning of the guide rails in the elevator shaft can be controlled by means of the adjustment holes 614. The body part of the guide fixing bracket has planar surfaces 63*a* and 63*b* against the guide rails 61 and 62.

Figure 7:
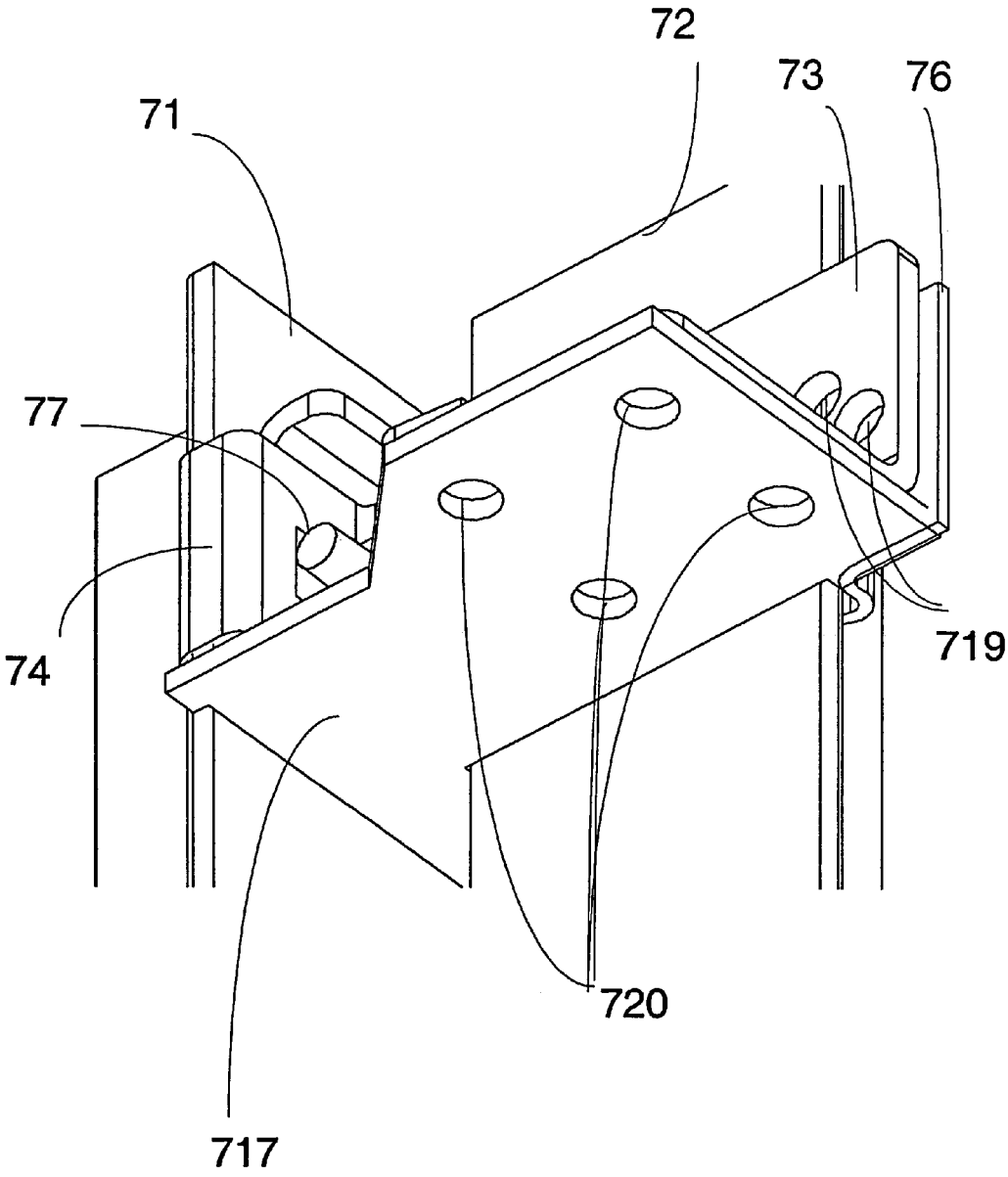
FIG. 7 presents the guide fixing bracket of FIG. 6 and the guide rails fitted to it as seen obliquely from below.

FIG. 7 shows the guide fixing bracket in FIG. 6 as seen obliquely from below. In FIG. 6, the support plate 717 has places, preferably slots, fitted for the guide rails 71 and 72, by means of which the guide rails are properly positioned to the guide fixing bracket. The support plate 717 has places 719 and 720 for fastening the support plate 717 to the body part 73. The guide rails 71 and 72 are fixed to the body part 73 by means of rail clips 74, 76 and a third rail clip not visible in the figure, which holds both guide rail 71 and guide rail 72 in place. By means of a tightening element 77, rail clip 74 and the aforesaid rail clip not visible in the figure are tightened in place.

Figure 8:
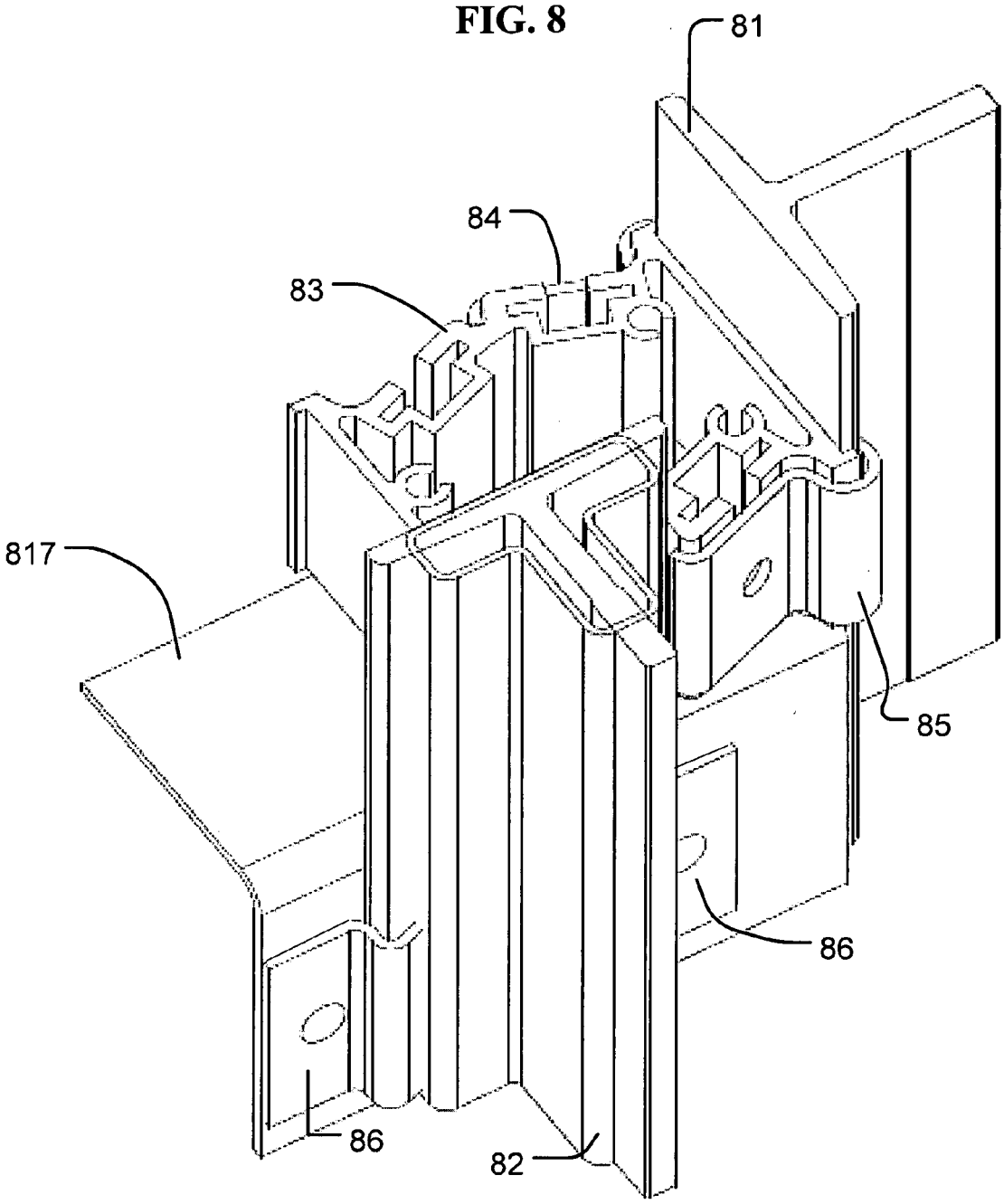
FIG. 8 presents a third guide fixing bracket according to the invention and its body part.

FIG. 8 presents a third embodiment of the invention. In FIG. 8, the opposite sides in the body part 83 of the guide fixing bracket may be identical to each other or they may differ in width. Due to this, it is possible to fix in place guide rails of different sizes and different widths by means of the same guide fixing bracket body part 83 by turning the body part 83 the other way round. In addition, the body part 83 in question allows the hand of the guide fixing bracket to be easily inverted. Fastened to the body part 83 is a support plate 817 having planar surfaces for the guide rails. To allow the guide rails 81,82 to be fitted in place, the body part is provided with fitting places, preferably slots, by the aid of which the guide rails can be accurately positioned. The guide rails 81,82 are fastened in place by means of rail clips 85,84,86. In the figure, the within of the rail clip near the car guide rail 81 substantially equals the width of the car guide rail plus the thickness of the rail clips 84,85 in the guide fixing bracket. The guide fixing bracket is fitted in place on the wall structure of the elevator shaft in a manner known in itself.

In the foregoing, the invention has been described by way of example with reference to the attached drawings while different embodiments of the invention are possible in the scope of the inventive concept defined in the claims. It is obvious to the skilled person that the guide rails used in the elevator may have a shape differing from that presented in the examples; for instance, it is possible to use only solid guide rails of T-shaped cross-section. It is further obvious to the skilled person that the material of the guide rails used may vary depending on the application.

The invention claimed is:

1. An elevator, comprising at least an elevator car moving along guide rails, a counterweight moving along guide rails, and an elevator motor for driving the elevator car and the counterweight, wherein at least one of the guide rails of the elevator car and the counterweight is fixed in place by guide fixing brackets whereby a width of one of the guide fixing bracket in the vicinity of the elevator car guide rails is substantially equal to a width of the elevator car guide rail and a thickness of rail clips in the guide fixing bracket, and one of the rail clips serves to fix in place the elevator car guide rail and the counterweight guide rail.

2. The elevator according to claim 1, wherein the guide fixing bracket has at least one tightening element for fastening and tightening the rail clips and holding at least one guide rail in place.

3. The elevator according to claim 2, wherein the guide fixing bracket has only one tightening element for the guide rails to be fixed.

4. The elevator according to claim 2, wherein the at least one tightening element is a bolt.

5. The elevator according to claim 1, wherein the elevator includes a machine room.

6. The elevator according to claim 1, wherein the elevator is without a machine room.

7. A guide fixing bracket, comprising at least a body part, rail clips, and tightening elements, wherein the guide fixing bracket, in a vicinity of an elevator car guide rail, has a width being substantially equal to a width of the elevator car guide rail and a thickness of rail clips in the guide fixing bracket, and one of the rail clips serves to fix in place the elevator car guide rail and a counterweight guide rail.

8. The guide fixing bracket according to claim 7, wherein the guide fixing bracket has at least one tightening element for fastening and tightening the rail clips and holding at least one guide rail in place.

9. The guide fixing bracket according to claim 8, wherein the at least one tightening element is a bolt.

10. The guide fixing bracket according to claim 8, wherein the guide fixing bracket has only one tightening element for the guide rails to be fixed.

11. The guide fixing bracket according claim 7, wherein the guide fixing bracket is used to fix at least two guide rails.

12. The guide fixing bracket according claim 7, wherein at least the body part of the guide fixing bracket is made a light material.

13. The guide fixing bracket according claim 12, wherein at least the body part of the guide fixing bracket is made of aluminum.

14. The guide fixing bracket according claim 7, wherein parts of the guide fixing bracket are made of a light material.

15. The guide fixing bracket according claim 14, wherein parts of the guide fixing bracket are made of aluminum.

16. The guide fixing bracket according claim 7, wherein the guide fixing bracket comprises at least a support plate, which is provided with fitting places for the guide rails and which can be fitted to the body part.

17. The guide fixing bracket according claim 7, wherein the guide fixing bracket has a place for fixing at least two guide rails.

* * * * *